United States Patent [19]

Roskvist

[11] 4,366,904

[45] Jan. 4, 1983

[54] STORAGE CONTAINER FOR CARDS AND SIMILAR ARTICLES

[76] Inventor: Carl-Eric B. Roskvist, Lavendelvägen 18, S-237 00 Bjärred, Sweden

[21] Appl. No.: 307,292

[22] Filed: Sep. 30, 1981

[51] Int. Cl.[3] ..... B42F 17/12; B42F 7/12

[52] U.S. Cl. ..... 206/425; 220/22.3; 206/561; 206/44 B

[58] Field of Search ..... 206/425, 45.15, 45.11, 206/449, 44 B, 561; 220/22, 22.1, 22.2, 22.3; 229/43; 70/63; 40/403, 380, 388

[56] References Cited

U.S. PATENT DOCUMENTS

| | | | |
|---|---|---|---|
| 1,575,021 | 3/1926 | Van Vlissingen | 220/22.1 |
| 2,054,385 | 9/1936 | Meier | 40/380 X |
| 2,665,808 | 1/1954 | McAlister | 206/425 |
| 3,863,833 | 2/1975 | Swett et al. | 229/43 |
| 3,913,250 | 10/1975 | Spees | 40/380 |
| 4,138,015 | 2/1979 | Rabley | 206/561 |

FOREIGN PATENT DOCUMENTS

| | | | |
|---|---|---|---|
| 1292033 | 4/1969 | Fed. Rep. of Germany | 70/63 |
| 415552 | 1/1967 | Switzerland | 220/22.1 |

*Primary Examiner*—William T. Dixson, Jr.
*Assistant Examiner*—Brenda J. Ehrhardt
*Attorney, Agent, or Firm*—Bucknam and Archer

[57] ABSTRACT

A storage container for cards and similar articles, having a base tray upon which a series of index separator panels are received in a spaced-apart arrangement that accommodates the ordered stacking of cards between panels. The base tray has a series of slot apertures through which are inserted tabs of respective separator panels. Adjacent each aperture, are a pair of ridge members on the base tray. The ridge members have configurations that cooperate with those of lugs on the tabs of the separator panels to limit the pivotal movements of such panels and prevent their accidental withdrawal from the base tray.

7 Claims, 8 Drawing Figures

FIG. 4
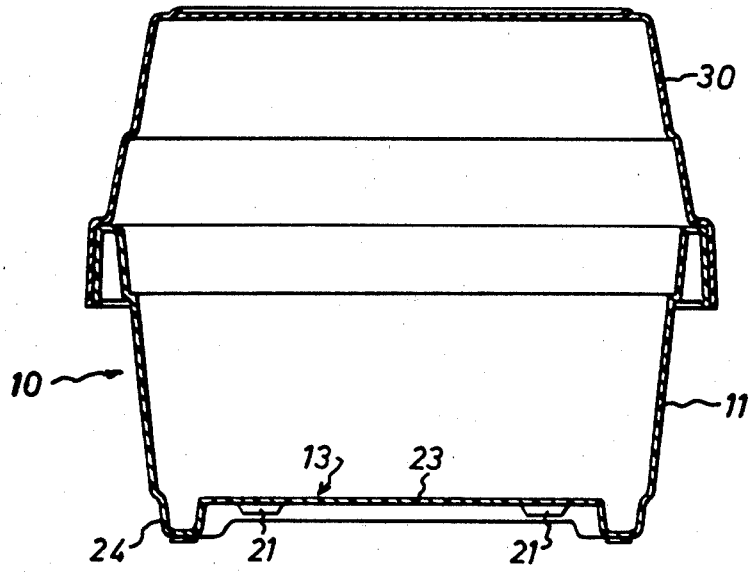
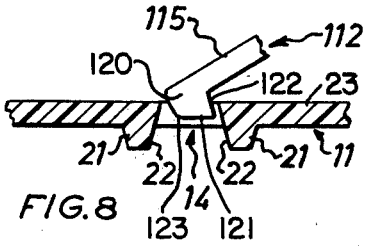
FIG. 8

STORAGE CONTAINER FOR CARDS AND SIMILAR ARTICLES

BACKGROUND AND SUMMARY OF THE INVENTION

This invention relates in general to devices for holding and storing cards or similar articles, and more particularly to a storage container for cards and the like.

In prior art card storage containers, or card boxes, there are provided index separator panels, or card rests, that accommodate an ordered stacking of cards and have lower tabs that are received in slot apertures on the bottom of the box. These tabs and slot apertures are so configured as to allow the separator panels to pivot forward and backward to an extent greater than that normally desired, and sometimes the tabs become accidentally withdrawn from the slots. To limit the pivotal movement of such prior art separator panels, they have been made with laterally projecting wings that hook against the edges of side walls of the card box. This feature complicates the structure of the card box, particularly where it is to be provided with a cover or lockable enclosure.

The invention provides a storage container for cards and the like, which comprises a base tray; means defining a plurality of apertures in said base tray; a plurality of index separator panels, each of said panels having at least one tab received in a corresponding one of said apertures to support the panel upon the base tray for limited pivotal movement relative thereto, said tab having a projecting lug; and a ridge member on said base tray adjacent said one aperture and having a configuration cooperation with that of said lug to limit the pivotal movement of said panel.

Thus, the card storage container of the invention utilizes the combination of ridges on the base tray and lugs on the separator panels to limit the pivotal movement of such panels and prevent their accidental withdrawal. Consequently, the separator panels and side walls of the card box or the base tray can be of independent configurations.

Other and further features and advantages of the invention will become apparent from the following detailed description and the accompanying drawings.

BRIEF DESCRIPTION OF THE DRAWINGS

In the drawings:

FIG. 4 is a front elevation sectional view of the card storage container shown in FIG. 1.

FIG. 8 is an enlarged detailed view of a container bottom portion taken similar to FIG. 7 but showing a typical index separator panel tab lug and typical ridge members adjacent a base tray aperture, according to another embodiment of the invention.

DESCRIPTION OF PREFERRED EMBODIMENTS OF THE INVENTION

Figure 1:
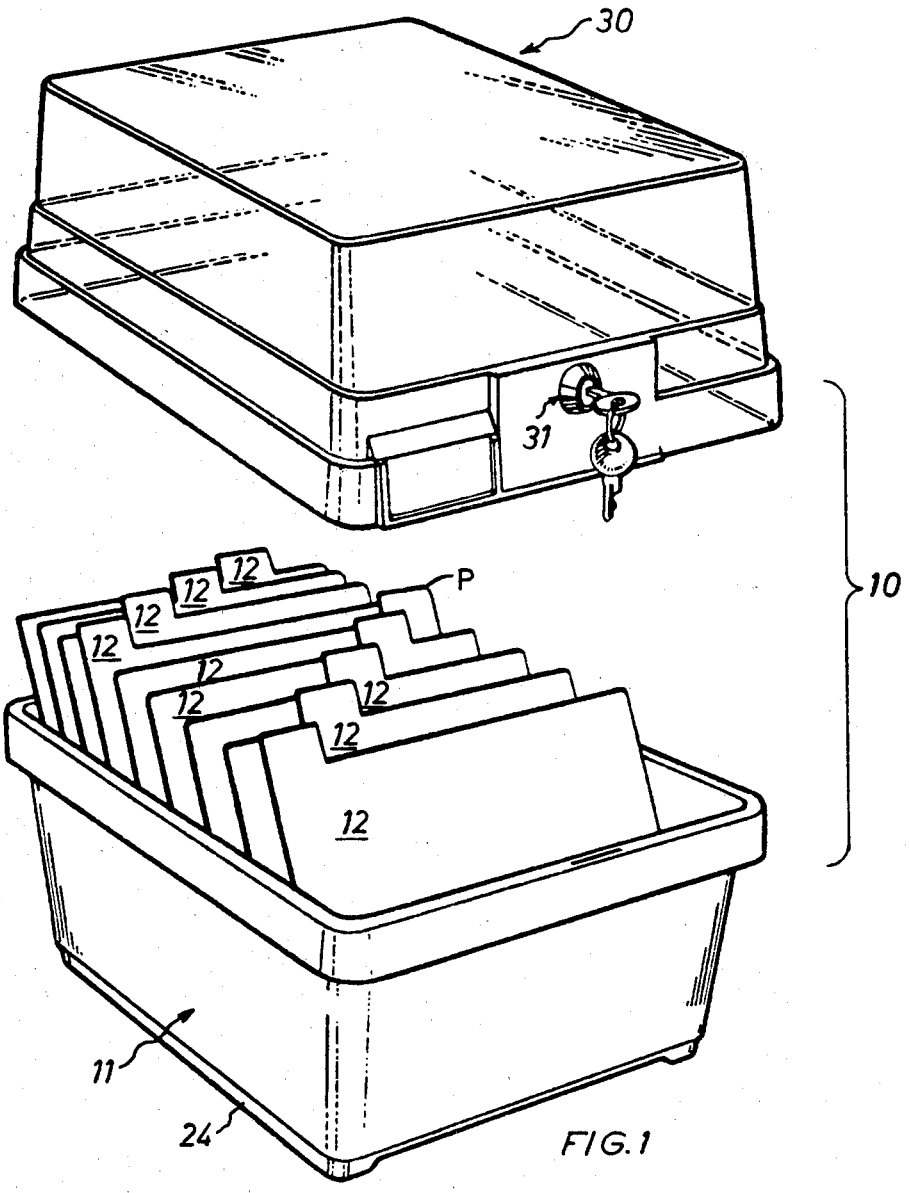
FIG. 1 is an exploded perspective view of a card storage container according to a preferred embodiment of the invention and showing such container as used in conjunction with a typical set of index separator panels also in accordance with the invention.

As exemplified generally by FIGS. 1–4, the invention is directed to a storage container 10 for cards and the like, which container 10 has a base tray 11 and a plurality of index separator panels 12. Base tray 11 has a bottom 13 in which there are a plurality of apertures 14, shown by FIGS. 2, 7 and 8.

Construction of a typical index separator panel 12 is shown by FIGS. 5–8 wherefrom it can be noted that each panel 12 has at least one, but preferrably two tabs 15 each received in a corresponding one of the tray apertures 14 when the container 10 is ready for its intended use. When the panels 12 are emplaced as shown by FIG. 1 the cards or similar items (not shown) to be stored are stacked between respective adjacent pairs of panels 12 in a conventional manner.

It should be understood that the storage container 10 described herein can be used also for storing flat objects of various types, or recordings such as are commonly designated as "floppy discs", (flexible discs).

Tabs 15 of each panel 12 are received in respective apertures 14 to support the panel 12 upon the base tray 11 for limited pivotal movement relative thereto between a front limit position and a rear limit position. For convenient access to cards and easy handling, each panel 12 has a front limit position that is about a 30 degree angle to the vertical with respect to the general plane of the base tray bottom 13 taken as a horizontal reference. The rear limit position is at about a 25 degree angle to the vertical.

The dislodgement problems encountered with the prior art panels are avoided by providing each tab 15 on the panels 12 with a projecting lug 20, and ridge members 21 on the base tray 11 adjacent corresponding apertures 14 thereof. The ridge members 21 are preferably located one on each side of the respective apertures 14, and have a configuration co-operating with that of the tab lug 20 to limit the pivotal movement of the associated panel 12.

Figure 2:
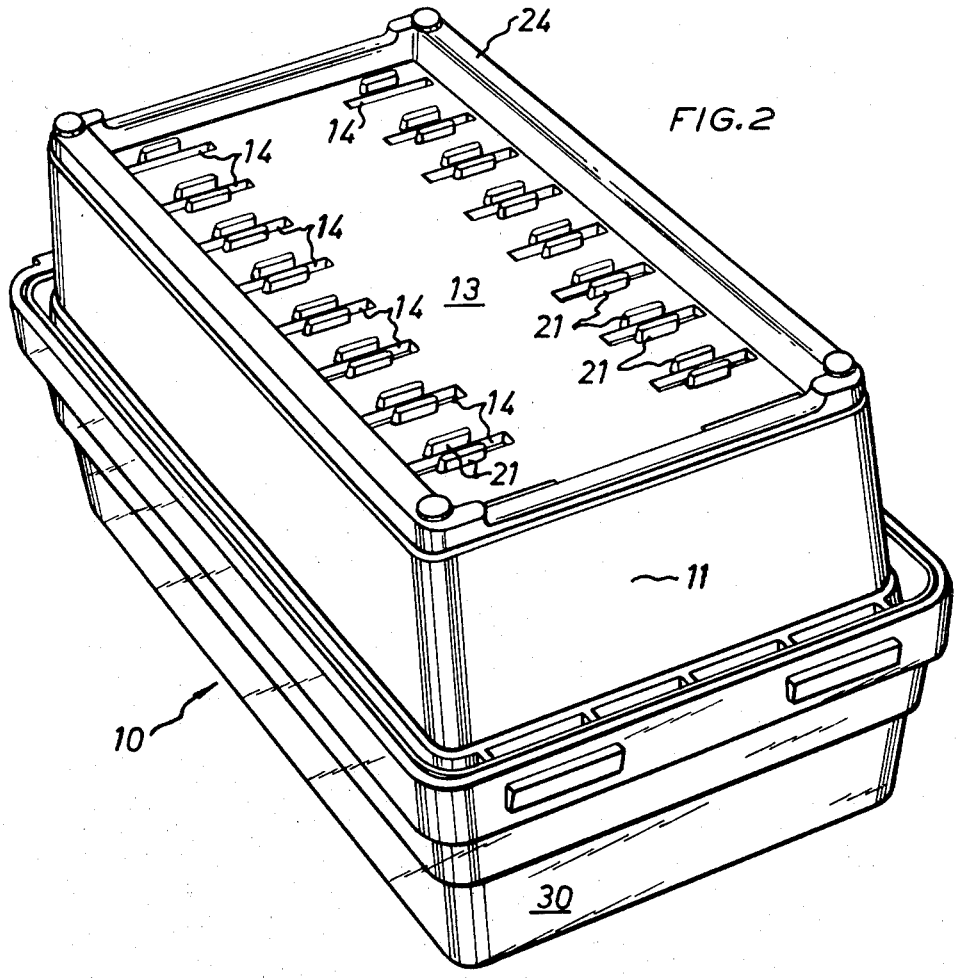
FIG. 2 is a bottom view of the card storage container shown in FIG. 1.
Figure 3:
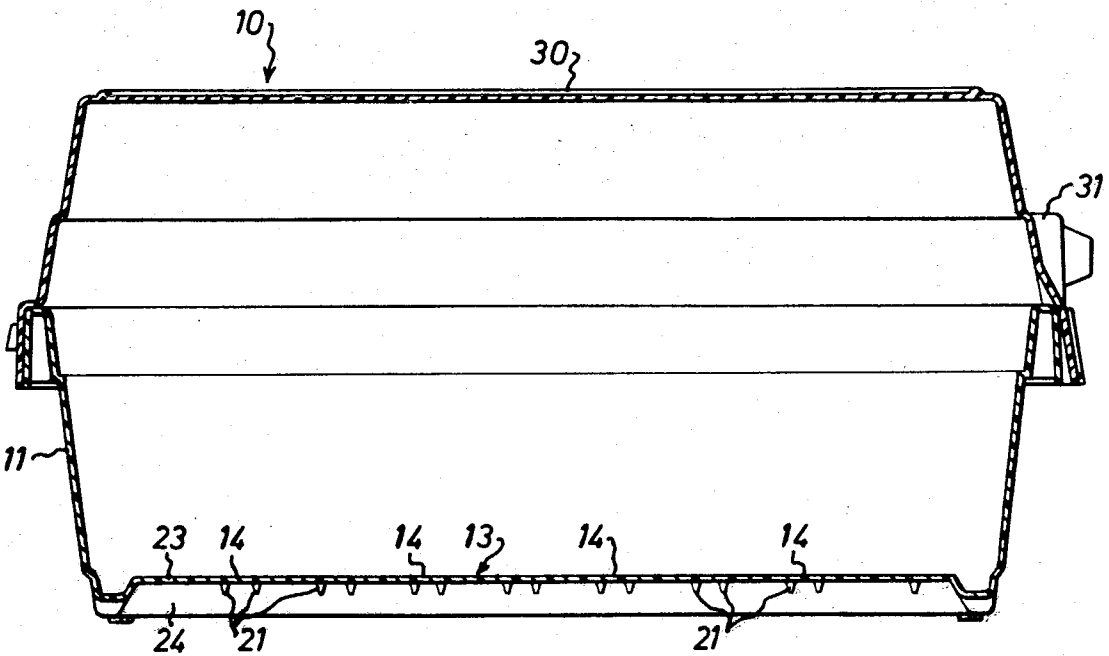
FIG. 3 is a side elevation sectional view of the card storage container shown in FIG. 1.

From FIGS. 2, 3, and 4 it can be noted that the several apertures 14 are in the form of elongated slots spaced apart along the lengthwise dimension of the container 10 and its bottom 13 in generally parallel relation to one another. For separator panels 12 having a pair of tabs 15, that are spaced apart along the widthwise dimension of the container, when installed thereon, two series of apertures 14 are provided correspondingly spaced along said widthwise dimension.

A pair of ridge members 21 is located adjacent each aperture 14, the ridge members 21 of the pair being disposed in opposite relation about the respective aperture 14.

Figure 7:
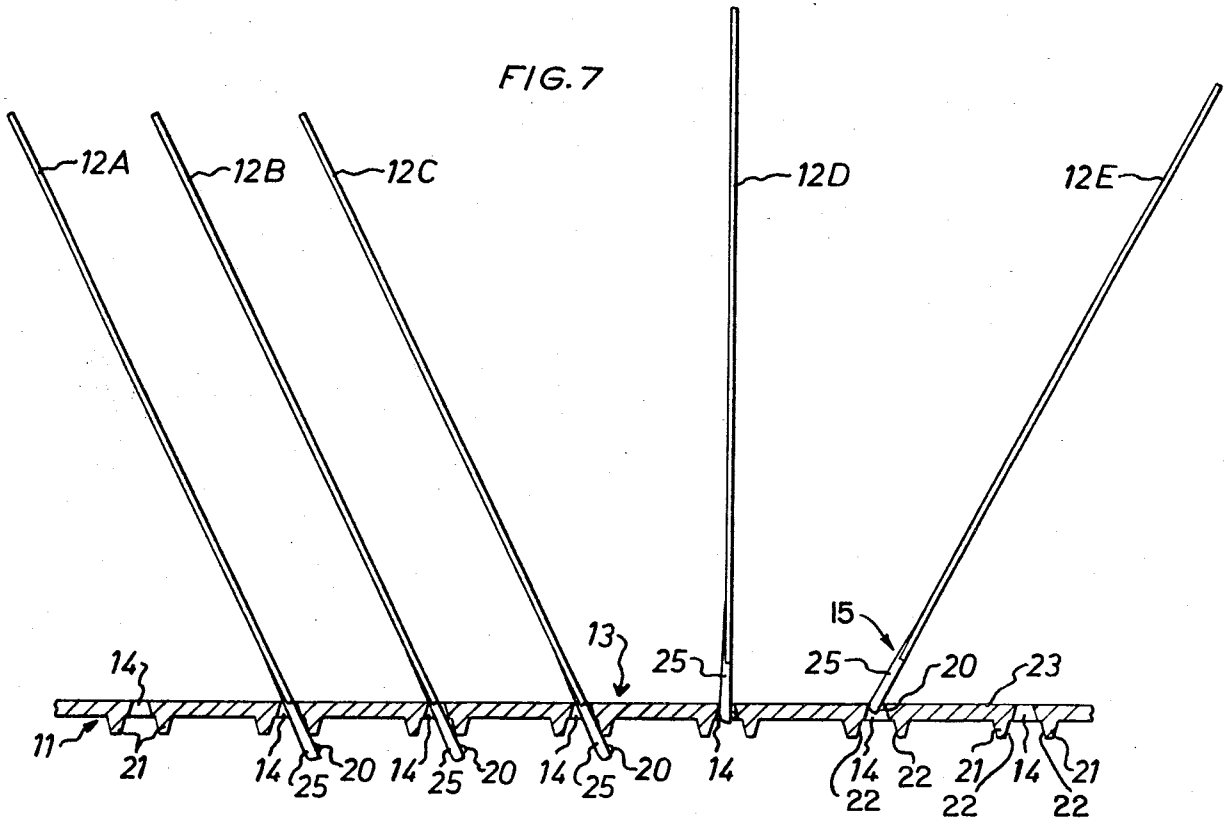
FIG. 7 is a side sectional view taken through a typical portion of the bottom of the card storage container shown in FIG. 1 and showing individual index separator panels.

As better seen from FIGS. 7 and 8, the ridge members 21 each have opposed surfaces 22 inclined with respect to the normally horizontal reference surface 23 of the base tray 11 bottom 13. Since the ridge members 21 cooperate with the lugs 20 on panels 12, such members 21 need not be coextensive in length with the apertures 14, but rather need only be of such length and lengthwise location relative to the apertures 14 as to effectuate engagement by the lugs 20. Accordingly, the ridge members 21 shown in FIG. 2 are less than the full length of the apertures 14, but could be increased to the full length thereof, if so desired.

Preferrably, the base tray 11 bottom 13 has a peripheral support 24 that will keep the surface 23 raised sufficiently above a table or other flat surface (not shown) upon which the container 10 is placed, so that the tabs 15 do not touch the underlying flat surface.

Figure 5:
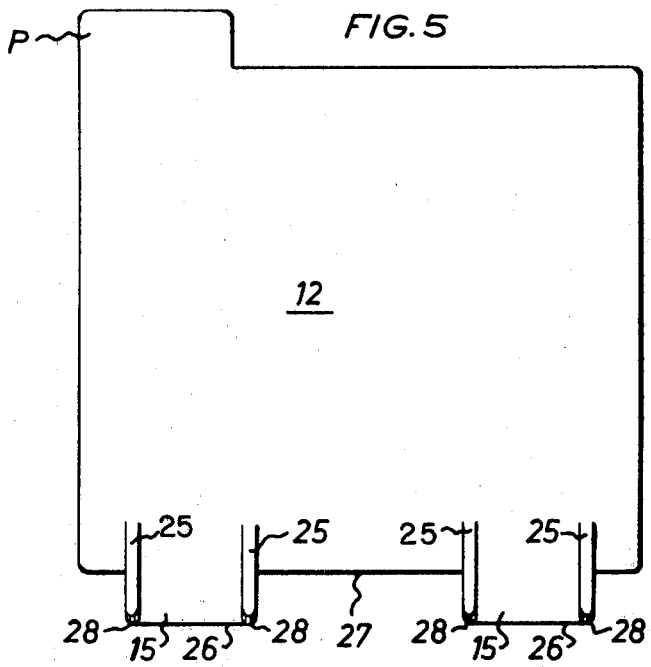
FIG. 5 is a rear view of a typical index separator panel according to the invention, and which is used in the card storage container of FIG. 1.
Figure 6:
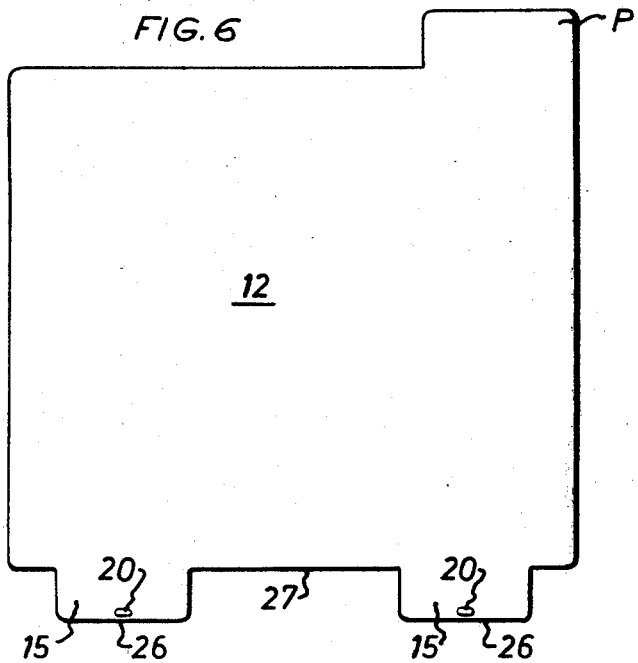
FIG. 6 is a frontal view of the index separator panel shown in FIG. 5.

FIGS. 5, 6 and 7 show a separator panel 12 that is generally planar and rectangular, and has a certain degree of bending flexibility, as for example, a panel 12 made of plastic. Panel 12 has a pair of tabs 15 each provided with a pair of ribs 25 that extend upwardly, decreasing in thickness from the bottom edge 26 of the tab 15.

In the particular embodiment shown by FIGS. 5 and 6, the ribs 25 are on one side (rear) of the panel 12 and the lugs 20 are on the opposite side thereof. With the surfaces 22 of the ridge members 21 being oriented in symmetry about respective apertures 14, as shown by FIG. 7, and the tabs 15 being located symmetrically about the width centerline of the panel 12, it actually makes no difference which side of the panel 12 is considered front or back, as the panels can be inserted facing either way.

At its upper edge, the panel has a projecting tab P which can be located at various distances from the side edge of the panel, as shown in FIG. 1, and tab P merely serves to carry an index legend, and thus is not part of the invention.

FIG. 7 shows three panels 12A, 12B, 12C installed in the base tray 11 and resting their rear limit positions, in which they make an angle of about 25° with the vertical to surface 23. One panel 12D is shown in an intermediate position, as would typically result if the base tray were turned upside down. In such intermediate position, the panel 12D would still remain captured in the base tray 11, and would simply hang therefrom if tray 11 were upside down. Panel 12D cannot be removed from tray 11 while in the intermediate position because the overall thickness of each of its tabs 15, including the thickness of associated ribs and lugs 20, is too great to permit passage of either tab 15 through the respective slot aperture 14. Panel 12E is shown at rest in its forward limit position, in which it makes an angle of about 30° with the vertical to surface 23. This forward limit position is the one wherein the panel 12E, or any typical panel 12A–12E, would be inserted into or removed from tray 11.

As shown in FIG. 7, the panels 12A, 12B, 12C engage the surface 23 with their edge portions 27 that are located between their tabs 15, whereas the panel 12D in the intermediate position, and panel 12E in the forward limit position, are somewhat raised. Panel 12E could, however, be pushed down somewhat similar to the panels 12A–12C, so that its lugs 20 would lie below the ridge member 21 as would be in abutting contact with the ribs 25 on panel 12E. This would give a forward limit position slightly less forward than that shown with panel 12E raised.

Preferrably, the ribs 25 are rounded at their lower end portions 28 rather than made with sharp corners thereat, in order to facilitate the swinging in and out of the panels 12A–12E through the apertures 14.

FIG. 8 shows a typical panel 112 according to another embodiment of the invention, in which the tab 115 has a lug 120 with intersecting bevel surfaces 121, 122 and an end portion 123 that is either rounded or tapered to permit the panel 112 to be swung into and out of the aperture 14 in a manner similar to the insertion and removal of the panels 12A–12E in FIG. 7.

From the foregoing, the artisan will appreciate that basically the ridge members 21 have configurations established by the inclination of their surfaces 22, and the extension thereof below the surface 23 of base tray 11. The ridge member configurations cooperate with those of the lugs to limit the pivotal movement of the panels and to prevent their removal except when positioned to a predetermined angle. Specific angles of inclination of the panels 12 etc., can of course be varied by selection of the angles and sizes of the ridge members surfaces, and the width of the slot apertures 14 in relation to the lug 20 geometry chosen.

The container 10 can be expediently made of plastic, and can be provided with a cover 30 and lock 31 to lock the cover 30 to the base tray 11.

Other and further variations of the invention will become apparent to the artisan from the foregoing description.

What is claimed is:

1. A storage container for cards and the like, which comprises a base tray; means defining a plurality of apertures in said base tray; a plurality of index separator panels, each of said panels having at least one tab received in a corresponding one of said apertures to support the panel upon the base tray for limited pivotal movement relative thereto, said tab having a projecting lug and a tapered rib; and a pair of oppositely disposed ridge members on said base tray adjacent said one aperture; said ridge members having respective configurations co-operating with those of said lug and tapered rib to limit the pivotal movement of said panel; said lug and tapered rib of the tab co-operating with said ridge members to prevent removal of the tab from the corresponding aperture except when the tab is at a predetermined inclination with respect to the base tray.

2. A storage container according to claim 1 including a cover receivable upon said base tray for support thereby.

3. A storage container according to claim 2 including lock means operable to secure said cover to said base tray.

4. A storage container according to claim 1 wherein each of said index separator panels has a pair of said tabs disposed in spaced-apart relation transversely on the panel, each of said tabs of the panel being received in a corresponding slot aperture of said base tray.

5. A storage container according to claim 1 wherein said tab has generally flat forward and back surfaces and said lug projects from the forward surface of the tab.

6. A storage container according to claim 1 wherein said ridge members have surfaces inclined with respect to a reference surface of the base tray.

7. A storage container according to claim 1 wherein said lug member has surfaces disposed for respective engagement with corresponding surfaces on a pair of said ridge members to limit the pivotal movement of the corresponding panel in a forward direction and to limit such pivotal movement in a backward direction.

* * * * *